US012710048B2

(12) United States Patent
Welschinger et al.

(10) Patent No.: US 12,710,048 B2
(45) Date of Patent: Aug. 18, 2026

(54) CENTRIFUGAL PUMP

(71) Applicant: Sulzer Management AG, Winterthur (CH)

(72) Inventors: Thomas Welschinger, Radolfzell (DE); Marc Widmer, Winterthur (CH)

(73) Assignee: Sulzer Management AG, Winterthur (CH)

( * ) Notice: Subject to any disclaimer, the term of this patent is extended or adjusted under 35 U.S.C. 154(b) by 0 days.

(21) Appl. No.: 19/223,167

(22) Filed: May 30, 2025

(65) Prior Publication Data

US 2025/0382969 A1 Dec. 18, 2025

(30) Foreign Application Priority Data

Jun. 18, 2024 (EP) ..... 24182843

(51) Int. Cl.
*F04D 29/041* (2006.01)
*F04D 1/06* (2006.01)
*F04D 29/047* (2006.01)

(52) U.S. Cl.
CPC ..... *F04D 29/0413* (2013.01); *F04D 1/06* (2013.01)

(58) Field of Classification Search
CPC ..... F04D 29/041; F04D 29/0413; F04D 29/0416; F04D 1/06; F04D 1/08; F04D 17/122; F04D 13/086; F04D 29/056; F04D 29/043; F04D 29/18; F04D 29/185; F04D 29/406; F01D 25/168; F01D 3/04; F05D 2260/6022; F16C 17/04; F16C 17/02; F16C 23/02; F16C 2360/44; F16C 27/08; F16C 32/0442
See application file for complete search history.

(56) References Cited

U.S. PATENT DOCUMENTS

2013/0136629 A1 5/2013 Maier
2018/0274548 A1 9/2018 Vidalenc et al.
2022/0178381 A1* 6/2022 De Raeve ..... F04D 1/06
2022/0220980 A1* 7/2022 Tischler ..... F04D 29/0416

FOREIGN PATENT DOCUMENTS

CN 101644269 A 2/2010
WO 2011078680 A1 6/2011

OTHER PUBLICATIONS

Extended European Search Report received for EP Application No. 24182843.3, mailed on Nov. 18, 2024, 20 pages.

* cited by examiner

*Primary Examiner* — Eric J Zamora Alvarez
(74) *Attorney, Agent, or Firm* — Spencer Fane, LLP

(57) ABSTRACT

A centrifugal pump includes a housing including a pump inlet and a pump outlet, a rotor arranged in the housing, and including an impeller to convey fluid from the inlet to the outlet and a pump shaft extending from a first end to a second end, the impeller fixedly connected to the pump shaft, a balance disk fixedly connected to the first end of the pump shaft and cooperating with a stationary counter ring, to provide a radial gap between the balance disk and the counter ring, so that a movement of the pump shaft in the axial direction closes or opens the radial gap, and a balance drum fixedly connected to the pump shaft adjacent the second end of the pump shaft and cooperating with a stationary counterpart to provide an axial gap between the balance drum and the counterpart.

15 Claims, 1 Drawing Sheet

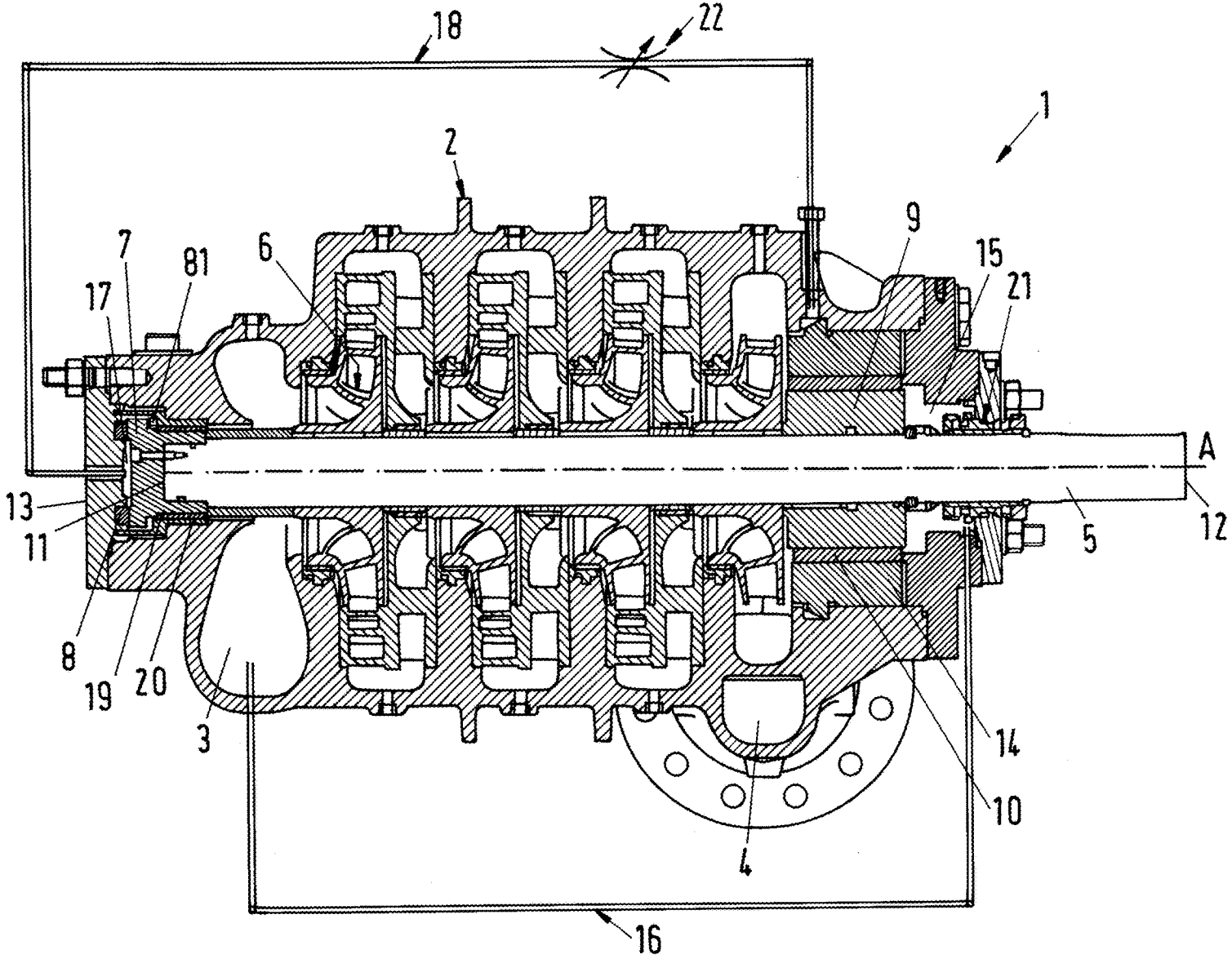
1
A
12
5
21
15
9
14
10
4
22
16
18
2
6
81
7
17
3
20
19
8
13
11

CENTRIFUGAL PUMP

CROSS-REFERENCE TO RELATED APPLICATION

This application claims priority to European Application No. 24182843.3, filed Jun. 18, 2024, the contents of which are hereby incorporated herein by reference.

BACKGROUND

Technical Field

The disclosure relates to a centrifugal pump for conveying a process fluid.

Background Information

Today, energy efficiency is of paramount concern for any type of pumps, particularly in applications with long life and runtimes, high throughput, and where large pressure differences, referred to as large head, need to be realized. The latter is often achieved by using multistage centrifugal pumps, wherein a plurality of impellers may be mounted in series on the same pump shaft. At each stage, the pumped fluid enters an impeller at its center, before being accelerated through centrifugal forces and redirected to the discharge at the outer diameter of the impeller, where the elevated pressure is generated following Bernoulli's equation. The fluid at elevated pressure is then either discharged from the pump or directed to the inlet of a next impeller. However, due to the pressure difference across each impeller, an axial thrust is generated, which is related to the produced head, and which must be properly handled to ensure longevity of the pump. In particular, axial thrust bearings are provided, which are loaded with said axial thrust. However, these bearings can suffer from increased friction and thus wear, complex construction and maintenance, vulnerabilities to misalignment, limited shock and vibration absorption, and high cost.

SUMMARY

Due to the pressure difference across each impeller, an axial thrust is generated, which is related to the produced head, and which must be properly handled to ensure longevity of the pump. In particular, axial thrust bearings are provided, which are loaded with the axial thrust. However, these bearings can suffer from increased friction and thus wear, complex construction and maintenance, vulnerabilities to misalignment, limited shock and vibration absorption, and high cost.

One example application where such multistage centrifugal pumps are used, is seawater desalination by reverse osmosis, wherein highly efficient pumps with large head are required. Therein, already 0.1% higher pump efficiency can play a crucial role. Other applications include boiler feed systems to supply water to steam boilers, water supply boosting to transport water to elevated locations, such as the upper floors of tall buildings, or ensuring that water is distributed efficiently across vast agricultural fields in irrigation systems.

Known solutions to alleviate, or in the limit case completely compensate, the axial thrust generated by impellers of centrifugal pumps include the use of balance disks, which hydraulically counteract the axial thrust generated by the impellers by providing an opposing force, in turn reducing the net thrust on the axial thrust bearing. Often, only one balance disk is used per rotor, irrespective of the number of impellers.

Such a balance disk is typically fixed to the pump shaft and configured to cooperate with a stationary counter ring for providing a radial gap between the balance disk and the counter ring so that a movement of the shaft in the axial direction closes or opens the radial gap. Furthermore, the balance disk comprises two axial faces, of which one face is exposed to a high pressure, and one face is exposed to a low pressure. The low-pressure face is in fluid communication with for example the pump inlet and is in this case exposed to a pressure at or slightly above the suction pressure. The high-pressure face delimits a chamber, and a flow channel provides the pumped fluid to the chamber with a pressure higher than the suction pressure, which in turn is derived from one of the impeller outlets.

The balance disk is typically located at the non-drive end of the shaft, which often is arranged at the discharge side of the pump where the last stage impeller creates the discharge pressure, while a disk-return-line connects the low-pressure face of the balance disk with the pump inlet. As the impeller rotates, the fluid pressure in the chamber exerts force on the balance disk, opposing the axial thrust generated by the impeller. Once the pressure in the chamber is sufficiently high, the force generated exceeds the axial thrust of the impellers and the balance disk, and in turn the pump shaft, is pushed away from the chamber, opening the radial gap. In turn, this gap allows the fluid to flow from the chamber, i.e., the high-pressure side of the balance disk, to the low-pressure side of the balance disk, which regulates the pressure in the chamber, and thus creates a self-compensating system wherein the force generated by the balance disk equals the force generated the impellers. Therefore, a balance disk can work as a product lubricated thrust bearing and thus enable centrifugal pumps to operate more efficiently.

However, the use of balance disks entails additional challenges, firstly related to internal leakage of the fluid through the radial gap from the high-pressure side to the low-pressure side of the balance disk, which, while necessary for thrust compensation, reduces the overall pump efficiency. Secondly, dimensioning the balance disk involves a trade-off between ensuring high operational reliability, which necessitates a disk with a large diameter, and maintaining high pump efficiency, which demands a disk with small diameter. These opposing requirements stem from the fact that the thrust compensation capability of the disk increases with an increasing diameter, whereas the power losses due to hydraulic friction in the radial gap, and the leakage flow through the radial gap both increase with an increasing diameter, which decreases the pump efficiency. Thirdly, mechanical friction during startup, when the radial gap is closed and the balance disk therefore touches the stationary counter ring due to insufficient pressure in the chamber, demands the use of highly abrasion resistant materials which increases the cost of the solution. In summary, when using a balance disk, operational reliability must always be balanced against energy efficiency during design, yet an increase of both, in other words a shift of the pareto curve, would be highly desirable.

Starting from this state of the art, it is therefore an object of the disclosure to propose a highly efficient centrifugal pump while ensuring high operational reliability. In particular, this pump shall be suitable for applications like reverse osmosis, where minimal efficiency losses as well as shortcomings in operational reliability could lead to significant cost and damages.

The subject matter of the disclosure satisfying this object is characterized by the features disclosed herein.

Thus, according to the disclosure, a centrifugal pump is proposed, wherein the pump comprises a housing with a rotor arranged in the housing, wherein the housing comprises a pump inlet for receiving a fluid at a suction pressure and a pump outlet for discharging the fluid at a discharge pressure, wherein the rotor comprises at least one impeller for conveying the fluid from the inlet to the outlet and a pump shaft for rotating about an axial direction, with the pump shaft extending from a first end to a second end, wherein each impeller is fixedly connected to the pump shaft, and wherein a balance disk is fixedly connected to the first end of the pump shaft and configured to cooperate with a stationary counter ring, for providing a radial gap between the balance disk and the counter ring, so that a movement of the pump shaft in the axial direction closes or opens the radial gap. A balance drum is fixedly connected to the pump shaft near the second end of the pump shaft and configured to cooperate with a stationary counterpart for providing an axial gap between the balance drum and the counterpart. As the balance drum compensates most of the axial thrust, the balance disk only needs to compensate a small residual thrust, and accordingly, the diameter of the balance disk can be considerably reduced. This leads to reduced friction losses and reduced leakage flow losses, in particular during transient operation, while still allowing for self-compensation of the system.

To operate such a pump in the most efficient manner, one preferred configuration is that the first end of the pump shaft is configured as a non-drive end, and the second end of the pump shaft is configured as a drive end. Herein, the term drive-end denotes the end of the pump shaft, which is connectable to a drive unit, such as an electric motor.

Further, one preferred configuration is that the pump inlet is arranged at the first end of the pump shaft, and the pump outlet is arranged at the second end of the pump shaft.

This entails that in this configuration, the balance drum is arranged at the drive end and the balance disk is arranged at the non-drive end of the pump shaft.

The balance drum preferably features a high-pressure side and a low-pressure side, wherein a cavity is arranged at the low-pressure side, and wherein a balance line provides a fluid connection between the cavity and the pump inlet, so that the pressure in the cavity is approximately the suction pressure. The balance drum and the stationary counterpart are configured to provide an axial counterthrust directed opposite to the axial thrust generated by the at least one impeller, wherein the diameter of the balance drum is selected such that the axial counterthrust is smaller than the axial thrust generated by the at least one impeller. As a result, best practice would be to dimension the diameter of the balance drum to compensate most of the axial thrust generated by the at least one impeller, so that the residual thrust to be compensated by the balance disk is minimal, yet always directed towards the pump inlet, allowing for stable operation in any state.

The balance disk preferably comprises an axial face delimiting a chamber. A transfer line is provided for supplying the fluid to the chamber with a pressure higher than the suction pressure. A preferred option is that the transfer line is connected to the high-pressure side of the balance drum. While other places in the pump where the pressure is higher than the suction pressure are also suitable connection points for the transfer line, this arrangement enables the smallest possible balance disk and thus minimized friction losses and accordingly lower power consumption and longer maintenance intervals.

To further decrease maintenance cost, one optional solution is to provide a rotating bushing which is fixed at the first end of the pump shaft and a stationary bushing which is arranged to surround the rotating bushing, the rotating bushing and the stationary bushing forming a radial bearing lubricated by the fluid. Herein, the product lubricated bearing at the first end of the pump shaft can be in fluid communication with the pump inlet, which allows for a simple and robust configuration. Besides their function as radial bearing, the rotating bushing and the stationary bushing also serve the purpose of a post throttle of the balance disk, which limits the pressure drop across the balance disk by providing an additional flow restriction downstream of the balance disk. This enables increased reliability of the balance disk in operation and prevents cavitation.

Furthermore, the balance drum and the stationary counterpart can also act as a radial bearing lubricated by the process fluid. Preferably, the extension of the gap between the balance drum and the stationary counterpart in radial direction is between 0.001 mm and 1 mm, more preferably between 0.01 mm and 0.8 mm, and most preferably between 0.02 and 0.4 mm. A favorable solution is that the balance drum and the stationary counterpart are the sole radial bearing at the second end of the pump shaft. One possible configuration is that the stationary counterpart of the balance drum comprises a bushing surrounding the balance drum. Therefore, this configuration can reduce the number of necessary classical axial or radial bearings which would need external lubrication, largely reducing complexity and maintenance requirements. Furthermore, if needed, the balance disk can be serviced at an easily accessible location at the non-drive end.

The preferred solution to seal the pump towards the environment is that a mechanical seal for sealing the pump shaft is arranged between the balance drum and the second end of the pump shaft. If the balance drum is arranged at the drive end, a great advantage of this solution is the low-pressure difference across the mechanical seal, which allows for a simple and cost-efficient product, low wear, and long life-time.

A preferred configuration is further, that a stationary inboard counter ring is configured to cooperate with the balance disk for providing an inboard radial gap between the balance disk and the inboard counter ring, so that a movement of the shaft in the axial direction closes or opens the radial gap. Particularly useful in transient conditions, this enables separation functions of the counter ring and the inboard counter ring, of which the former primarily serves the purpose of cooperating with the balance disk to form the radial gap during steady state operation and the latter serves the purpose of providing a stop in axial direction or dedicated friction bearing during transient operation conditions.

Another preferred configuration of the centrifugal pump is that a throttle is provided for adjusting the flow of the fluid supplied to the chamber, which allows for additional fine tuning of operation conditions.

Further advantageous measures and embodiments of the disclosure will become apparent from the dependent claims.

BRIEF DESCRIPTION OF THE DRAWINGS

The disclosure will be explained in more detail hereinafter with reference to embodiments of the disclosure and with reference to the drawings.

In the drawings is shown:

FIG. 1 shows a schematic cross-sectional view of an embodiment of a centrifugal pump according to the disclosure, designated in its entity by the reference numeral 1.

DETAILED DESCRIPTION

While the disclosure relates to single-stage or multi-stage centrifugal pumps, substantial advantages are predominantly realized for large head pumps, which are typically built in a multi-stage layout. Therein, all types, such as barrel, ring segment, or axial split versions are viable, yet the type is irrelevant for the function of the disclosure. To provide one example, the embodiment depicted in FIG. 1 is an axial-split multi-stage pump. The pump 1 comprises a housing 2, a pump inlet 3 for supplying the fluid to the pump 1 at a suction pressure, and a pump outlet 4 for discharging the fluid at a discharge pressure. This embodiment shows one pump inlet 3 and one pump outlet 4, however other embodiments might include multiple inlets and/or outlets, respectively.

A rotor is arranged in the housing 2, wherein the rotor comprises a pump shaft 5, extending from a first end 11 to a second end 12, for rotating about an axial direction A and at least one impeller 6 for conveying the fluid from the inlet 3 to the outlet 4, wherein each impeller 6 is fixedly connected to the pump shaft 5. The word fixedly herein refers to a torque proof and axial displacement proof fixation method of the impeller 6 to the pump shaft 5 for reliable operation. In this embodiment, pump 1 comprises four stages, which entails four impellers 6. In this embodiment, the pump 1 is arranged so that the first end 11 of the pump shaft 5 is configured as a non-drive end, and the second end 12 of the pump shaft 5 is configured as a drive end of the pump shaft 5. For operation of the pump 1, the drive end is connectable to a drive unit, such as an electrical motor.

Further, the pump 1 is configured so that the pump inlet 3 is arranged at the first end 11 of the pump shaft 5, and the pump outlet 4 is arranged at the second end 12 of the pump shaft 5.

A balance disk 7 is fixedly connected to the first end 11 of the pump shaft 5 and configured to cooperate with a stationary counter ring 8. Preferably, the counter ring 8 is made from a material with good bearing properties such as polytetrafluoroethylene (PTFE), polyether ether ketone (PEEK), or silicon carbide (SiC), or can be configured with a diamond face, or a diamond containing face. Furthermore, any metal or metal alloy can be used for the counter ring. In the shown embodiment, this counter ring 8 is integrated into the non-drive end cover 13 of the housing 2, which is a preferrable solution, yet other configurations, such as separate seating in a dedicated holding structure, or integration into the housing 2 are alternative options. Further, the centrifugal pump 1 in the shown embodiment comprises a stationary inboard counter ring 81, which is configured to cooperate with the balance disk 7 for providing an inboard radial gap between the balance disk 7 and the inboard counter ring 81, ultimately providing an axial stop for the rotor 5 in transient operating conditions, for example if a residual thrust would act towards the second end 12 of the pump shaft 5. Preferably, the inboard counter ring 81 is made from a material with good bearing properties such as polytetrafluoroethylene (PTFE), polyether ether ketone (PEEK), silicon carbide (SiC), coal, or pressed carbon, or can be configured with a diamond face, or a diamond containing face.

In addition, a balance drum 9 is fixedly connected to the pump shaft 5 near the second end 12 of the pump shaft 5 and configured to cooperate with a stationary counterpart 14, which can comprise a bushing 10. In this embodiment, the balance drum 9, the stationary counterpart 14 are configured so that an axial gap is provided between the balance drum 9 and the bushing 10, through which the pumped fluid can flow from a high-pressure side to a low-pressure side of the balance drum 9. At the high-pressure side of the balance drum 9, a pressure prevails that is essentially the same as the discharge pressure. It must be noted that the position of the balance drum 9 on the pump shaft 5 is an example and can vary depending on the specific configuration of the housing 2 and the impellers 6. To provide one example, the balance drum 9 could be arranged between two impellers 6 in a back-to-back arrangement of the pump 1.

A cavity 15 is arranged at the low-pressure side of the balance drum 9. A balance line 16 provides a fluid connection between the cavity 15 and the pump inlet 3. Thus, at the low-pressure side of the balance drum 9 a pressure prevails that is essentially the same as the suction pressure.

The balance disk 7 comprises an axial face, delimiting a chamber 17 at the high-pressure side of the balance disk 7. A transfer line 18 provides a fluid connection between the chamber 17 and the pump outlet 4, which is situated at the high-pressure side of the balance drum 9. Further, a throttle 22 can be provided for adjusting the flow of the fluid supplied to the chamber 17, preferably arranged in the transfer line 18.

A rotating bushing 19 can be fixed at the first end 11 of the pump shaft 5 and a stationary bushing 20 can be arranged to surround the rotating bushing 19 so that both form a radial bearing lubricated by the fluid, which can be in fluid communication with the pump inlet 3. Similarly, the balance drum 9 and the stationary counterpart 14, which comprises the bushing 10, can act as a product lubricated radial bearing, so that no other radial bearing is necessary at the second end 12 of the pump shaft 5. As known in the art, a product lubricated radial bearing is a bearing which is lubricated by the fluid conveyed by the pump so that no other lubricant is required.

For sealing the pump 1 towards the environment, a mechanical seal 21 or any other type of seal is arranged between the balance drum 9 and the second end 12 of the pump shaft 5. The pump 1 can for example be configured as a multistage pump for reverse osmosis for desalination of seawater, wherein the term seawater comprises raw seawater, purified seawater, pretreated seawater, and filtered seawater. In this application high pressure is needed to overcome the osmotic pressure that favors even distributions, so that pressurized seawater can be admitted to a semi-permeable membrane to separate the water molecules from other substances. In this example, high efficiency and operational reliability are required, which is enabled by pump 1. In addition, the use of product lubricated bearings, i.e., bearings that don't need to be lubricated by any additional substance other than the pumped fluid, is greatly advantageous as no separate lubrication substance and corresponding feeding system are necessary. Consequently, the absence of a separate lubrication substance prevents possible contamination of the pumped fluid with this substance.

It goes without saying that the disclosure is not restricted to this specific example but is related to centrifugal pumps in general.

What is claimed:

1. A centrifugal pump comprising:

a housing comprising a pump inlet configured to receive a fluid at a suction pressure and a pump outlet configured to discharge the fluid at a discharge pressure;

a rotor arranged in the housing, and comprising an impeller configured to convey the fluid from the inlet to the outlet and a pump shaft to rotate about an axial direction, with the pump shaft extending from a first end to a second end, the impeller fixedly connected to the pump shaft;

a balance disk fixedly connected to the first end of the pump shaft and configured to cooperate with a stationary counter ring, to provide a first gap extending in a radial direction and disposed in the axial direction between the balance disk and the counter ring, so that a movement of the pump shaft in the axial direction closes or opens the first gap; and a balance drum fixedly connected to the pump shaft adjacent the second end of the pump shaft and configured to cooperate with a stationary counterpart to provide a second gap extending in the axial direction axially disposed between the balance drum and the stationary counterpart.

2. The centrifugal pump in accordance with claim 1, wherein the first end of the pump shaft is configured as a non-drive end, and the second end of the pump shaft is configured as a drive end of the pump shaft.

3. The centrifugal pump in accordance with claim 1, wherein the pump inlet is arranged at the first end of the pump shaft, and the pump outlet is arranged at the second end of the pump shaft.

4. The centrifugal pump in accordance with claim 1, wherein the balance drum has a high-pressure side and a low-pressure side, a cavity is arranged at the low-pressure side, and a balance line provides a fluid connection between the cavity and the pump inlet, so that a pressure in the cavity is the suction pressure.

5. The centrifugal pump in accordance with claim 1, wherein the balance drum and the stationary counterpart are configured to provide an axial counterthrust directed opposite to an axial thrust generated by the impeller, and a diameter of the balance drum is selected such that the axial counterthrust is smaller than the axial thrust generated by the impeller.

6. The centrifugal pump in accordance with claim 1, wherein the balance disk comprises an axial face, delimiting a chamber and a transfer line is provided to supply the fluid to the chamber with a pressure higher than the suction pressure.

7. The centrifugal pump in accordance with claim 6, wherein the transfer line is connected to a high-pressure side of the balance drum.

8. The centrifugal pump in accordance with claim 6, further comprising a throttle to adjust the flow of the fluid supplied to the chamber.

9. The centrifugal pump in accordance with claim 1, wherein a rotating bushing is fixed at the first end of the pump shaft and a stationary bushing is arranged to surround the rotating bushing, the rotating bushing and the stationary bushing forming a radial bearing lubricated by the fluid.

10. The centrifugal pump in accordance with claim 9, wherein the radial bearing at the first end of the pump shaft is in fluid communication with the pump inlet.

11. The centrifugal pump in accordance with claim 1, wherein the balance drum and the stationary counterpart function as a product lubricated radial bearing.

12. The centrifugal pump in accordance with claim 11, wherein the balance drum and the stationary counterpart are the sole radial bearing at the second end of the pump shaft.

13. The centrifugal pump in accordance with claim 1, wherein a mechanical seal to seal the pump shaft is arranged between the balance drum and the second end of the pump shaft.

14. The centrifugal pump in accordance with claim 1, wherein the stationary counterpart of the balance drum comprises a bushing surrounding the balance drum.

15. The centrifugal pump in accordance with claim 1, wherein a stationary inboard counter ring is configured to cooperate with the balance disk to provide an inboard radial gap between the balance disk and the inboard counter ring, so that the movement of the pump shaft in the axial direction closes or opens the inboard radial gap.

* * * * *